US005240064A

United States Patent [19]

Vansnick et al.

[11] Patent Number: 5,240,064

[45] Date of Patent: Aug. 31, 1993

[54] METHOD FOR MOLDING A FUSIBLE CORE

[75] Inventors: Michel Vansnick, Wemmel; Luc De Keyzer, Brussels, both of Belgium

[73] Assignee: Solvay (Société Anonyme), Brussels, Belgium

[21] Appl. No.: 880,658

[22] Filed: May 11, 1992

[30] Foreign Application Priority Data

May 10, 1991 [FR] France ..... 91 05857

[51] Int. Cl.[5] ..... B22D 17/32

[52] U.S. Cl. ..... 164/457; 164/4.1; 164/113

[58] Field of Search ..... 164/154, 155, 113, 151, 164/4.1, 150, 312, 457

[56] References Cited

U.S. PATENT DOCUMENTS

| | | | |
|---|---|---|---|
| 3,893,792 | 7/1975 | Laczko | 164/155 |
| 4,019,561 | 4/1977 | Aoki | 164/155 |
| 4,660,620 | 4/1987 | Ozeki | 164/155 |
| 4,680,151 | 7/1987 | Fujita et al. . | |
| 4,743,190 | 5/1988 | Bunnschweiler et al. | 164/155 |
| 4,878,032 | 10/1989 | Hatamura | 164/155 |

FOREIGN PATENT DOCUMENTS

| | | | |
|---|---|---|---|
| 3142811 | 5/1983 | Fed. Rep. of Germany . | |
| 3410228A1 | 10/1984 | Fed. Rep. of Germany . | |
| 0015260 | 1/1989 | Japan | 164/155 |
| 2138174A | 10/1984 | United Kingdom . | |

OTHER PUBLICATIONS

Giesserei, vol. 78, No. 5, Mar. 4, 1991, pp. 146–150, Düsseldorf, DE; L. Iten: "Neue Druckgiessmaschinen mit digitaler Echtzeitregelung des Giessvorgangs".

Patent Abstracts of Japan, vol. 8, No. 280 (M-347) [17171], Dec. 21, 1984; & JP-A-59 150 652 (UBE Kosan K.K.) Aug. 28, 1984.

*Primary Examiner*—Mark Rosenbaum
*Assistant Examiner*—Erik R. Puknys
*Attorney, Agent, or Firm*—Spencer, Frank & Schneider

[57] ABSTRACT

A method for molding a fusible core from a molten metal, including filling a mold by forcing back molten metal under pressure into the mold by means of a positive displacement pump equipped with a pressure regulator and having an output rate, total filling of the mold corresponding to a manometric height; measuring the pressure of the forced-back metal; adapting the output rate of the positive displacement pump so that the growing pressure imposed on the forced-back molten metal does not undergo any sudden variation during filling of the mold; and limiting the pressure exerted on the molten metal to a maximum pressure value which is slightly higher than the manometric height.

3 Claims, 3 Drawing Sheets

METHOD FOR MOLDING A FUSIBLE CORE

BACKGROUND OF THE INVENTION

1. Field of the Invention

The present invention relates to a method for moulding a fusible core from molten metal, in which the molten metal is forced back under pressure into a suitable mould.

2. Background of The Related Art

The fusible cores used for moulding hollow plastic articles having portions with re-entrant angles must be free from:

casting gouges, such gouges generally being produced by sudden variations in filling cross-sections or by insufficient filling speeds caused, in particular, by back pressures in the mould which are difficult to control.

burrs, despite producing mould joint faces which are as perfect as possible. However, such faces result in an increase in the back pressure which involves the need for the provision of degassing vents, the latter not exhibiting a behaviour which is constant and reliable over time.

surface holes, covered with a thin metal film, which, due to the collapse of this film during subsequent use of the fusible core in injection moulding, give rise to surface defects in the injection-moulded plastic articles.

A technique which is widely used for moulding fusible cores consists in forcing back the molten metal, in a duct connected to the mould, through the effect of a gaseous pressure.

This technique, however, has two serious defects:

the back pressure in the mould varies over time particularly according to the condition of the degassing vents which tend to block up and, that being the case, even by imposing a pressure profile during moulding, it is impossible, during a series of moulding cycles, to know the filling level of the mould at all times, particularly when the mould has variable cross-sections.

the metal is forced back in an oscillating manner and often contains gas bubbles, which gives rise to the production of gouges and the formation of holes in the fusible cores produced in this manner.

Moreover, during moulding of certain types of fusible core, it is important to be able to tilt the mould during filling thereof in order to prevent any overflow of metal and hence the formation of waves.

In this case, use of the technique described above must be excluded, as it does not make it possible to know the level of the metal front in the mould at all times, and it becomes impossible to determine the precise moment when it is required to tilt the mould.

Another possible technique consists in using a positive displacement pump which permits a non-ambiguous relationship between the level reached by the molten-metal front in the mould and the amount of molten metal delivered by the pump.

However, this technique does not, a priori, permit uniform filling of moulds, in particular in the case of moulds having variable cross-sections and/or requiring one or more tilting operations during filling.

It is also known (Giesserei 1991, 78, No. 5, 4 March, p. 146–150) to inject the molten metal into the forming mould by means, for example, of a piston pump and, in this case, to measure the pressure of the fluid driving the pump and to slave this pressure to a predetermined profile, for example by means of a regulation loop.

However, in such methods, no account is taken of parasitic increases in pressure which are due, for example, to frictions which may be very considerable and even predominant given the low viscosity of the molten metal. This results in the measured and controlled pressure not reflecting the degree of filling of the mould and, consequently, in these methods not permitting efficient control of the filling of the mould and hence the production of fusible cores which are free from defects.

Consequently, the present invention relates to a method for moulding fusible cores using a positive displacement pump which, in a simple manner, permits uniform production of fusible cores which are virtually free from defects.

SUMMARY OF THE INVENTION

Consequently, the present invention relates to a method for moulding a fusible core from a molten metal, in which the molten metal is forced back into a mould by means of a positive displacement pump, which is characterised in that the pressure of the forced-back metal is measured and in that the output rate of the pump is adapted so that the growing pressure imposed on the forced-back molten metal does not undergo sudden variation throughout the filling cycle of the mould.

The positive displacement pump may be of any type adapted to the nature of the material, molten metal, to be processed. However, it is preferable to use a positive displacement pump of the type having a piston, since this type of pump permits a one-to-one relationship between the position of the piston and the quantity of molten metal forced back into the mould. In this case, during filling of the mould, the speed of displacement imposed on the piston of the positive displacement pump is controlled so as to prevent any sudden variation in the pressure exerted on the molten metal forced back into the mould during filling thereof.

According to a very simple embodiment of the method according to the invention, for the production of a fusible core, a first moulding operation is performed, imposing a constant displacement speed on the piston and the positions of the piston in respect of which a sudden variation in pressure of the forced-back molten metal is recorded are noted (passage of the molten-metal front forced back into variable cross-sections of the mould). Examination of the diagram of the variation in pressures noted as a function of the successive positions of the piston also makes it possible to determine the variation in speed to be imposed on the displacement of the piston, in these noted positions, in order to maintain filling at a pressure growing in a uniform manner and without sudden variation.

Consequently, by using, for example, a rapid regulation loop and a proportional hydraulic distributor feeding the command cylinder of the piston of the positive displacement pump, it is possible to impose on the displacement of the piston a speed which can vary so that the growing pressure imposed on the forced-back molten metal does not undergo any sudden variation throughout each filling cycle of the mould during subsequent moulding cycles.

The Applicant prefers to use a command of hydraulic type in order to control the displacements of the piston, but it is quite obvious that other types of command, such as, for example, a command by means of electric motor, may be employed within the scope of the method according to the invention.

The aim of the regulation to be performed is thus, by means of a preliminary test, to adapt the speed of displacement of the piston within a given range so that the pressure profile of the metal forced back into the mould does not undergo any sudden variation over time, this procedure being iterative until the mould is completely filled.

As has been stated previously, the degassing vents provided in the mould do not exhibit constant behaviour over time, and they may, indeed, tend to block up progressively or suddenly with, as direct consequence, the development of a considerable back pressure in the mould. As this back pressure may have an adverse influence on the pressure measured on the molten metal, it is important that the adjustment procedure of the moulding cycles is performed with moulds whose vents are kept clear. As soon as this adjustment procedure is completed and, consequently, during the subsequent industrial production cycle, any blocking-up of one or more vents has no effect on the filling of the mould since this is volumetric. In fact, the blocking-up of a vent is revealed solely by a drift in the pressures measured during successive filling operations.

As has been mentioned previously, tilting of the mould during filling thereof may prove to be essential during the production of certain types of fusible core, in order to prevent an overflow of the molten metal which may give rise to waves and thus lead to the production of defective fusible cores.

The method according to the invention may be easily adapted to the filling of moulds requiring such tilting.

In this case, by producing incomplete fusible cores during an initial production test, the values of displacement of the piston of the pump, which correspond to filling levels of the mould for which it is necessary to impose one or more successive tilting movements on the mould, are determined.

As soon as this point or these points are determined, a further initial filling of the mould is performed at a constant speed of displacement of the piston, tilting the mould to the appropriate values, and the diagram of variation in the pressure of the forced-back metal is noted. On the basis of this diagram, it is then possible to determine the positions of the piston for which it is appropriate to act on the speed of the piston and the variations in speeds to be imposed on the piston at these locations so as to produce a moulding cycle such that the pressure of the molten metal forced back into the mould grows according to a predetermined profile without sudden variation during each industrial production cycle.

In the method according to the invention, it is, moreover, shown to be advantageous to equip the pump with a pressure regulator whose role is to limit the maximum pressure exerted by the pump on the forced-back molten metal. In this manner, any risk of possible accident during industrial production is reduced and the application of too high a pressure at the end of filling of the mould, which could promote the formation of undesirable burrs on the moulded fusible cores, is prevented. As a general rule, the Applicant prefers the pressure regulator to limit the maximum pressure exerted on the molten metal to a value slightly higher than the manometric height corresponding to total filling of the mould.

According to a further embodiment of the method according to the invention, which has the advantage of being automated, a growing profile for the pressure of the molten metal to be forced back into the mould is determined beforehand, the pressure of the molten metal forced back during manufacture is continuously noted and, on the basis of this measurement, the output rate of the positive displacement pump is continuously regulated so as to comply with the predetermined growing pressure profile.

The method according to this alternative embodiment may advantageously be produced by employing an automatic comparator/regulator system which, at all times in the manufacturing cycle, compares the noted pressure of the forced-back molten metal with the momentary value of the predetermined pressure and which, in the event of a discrepancy between these two pressure values, acts on the output rate of the pump so as to compensate for this discrepancy.

BRIEF DESCRIPTION OF THE DRAWING

The method according to the invention is, moreover, explained in more detail in the following description of a first embodiment thereof and in which reference will be made to the figures of the appended drawings in which.

DESCRIPTION OF THE PREFERRED EMBODIMENTS

Figure 1:
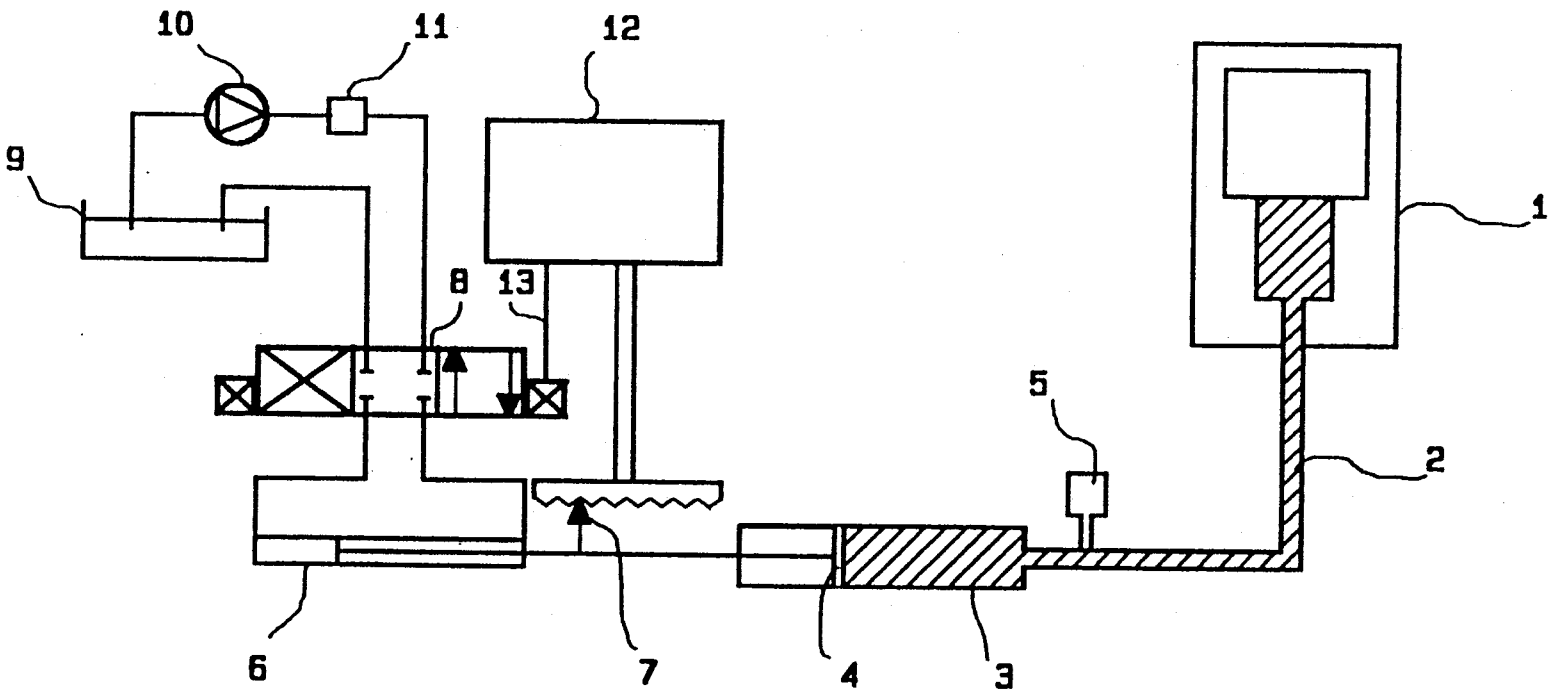
FIG. 1 is a diagrammatic view of a device for moulding fusible cores suitable for carrying out the method according to the invention, this device employing a positive displacement pump with piston.

The device as illustrated by FIG. 1 comprises a mould 1 adapted for moulding a fusible core, whose cavity is linked by a duct 2 to a positive displacement pump 3 with a piston 4 designed in order to permit a molten metal to be forced back into the cavity of the mould 1.

In accordance with the invention, the duct 2 is provided with a measuring device 5 permitting recording of the pressure of the forced-back molten metal.

The piston 4 is commanded by a hydraulic ram 6 and is equipped with a device 7 enabling the successive positions occupied by the piston 4 to be continuously noted.

The hydraulic ram 6 is supplied via a proportional distributor 8 linked to a pressurised hydraulic fluid supply circuit comprising a storage vessel 9, a pump 10 and a pressure regulator 11 which limits the pressure of the hydraulic fluid delivered to a value of 20 bars.

The device is completed by a rapid regulation loop 12 which, via the command 13, controls the proportional distributor 8, this loop being linked to the device 7 noting the momentary position of the piston 4.

In accordance with the method according to the invention, the device as described is employed as follows, with a view to the production of a series of fusible cores.

In a first stage, a first fusible core is produced by imposing a constant speed of displacement on the piston 4 and thus at a constant output rate of forced-back molten metal and, during this production cycle, the pressure of the forced-back molten metal is continuously noted with the aid of the device 5 and the successive positions corresponding to the piston 4 are noted with the aid of the device 7.

Figure 2:
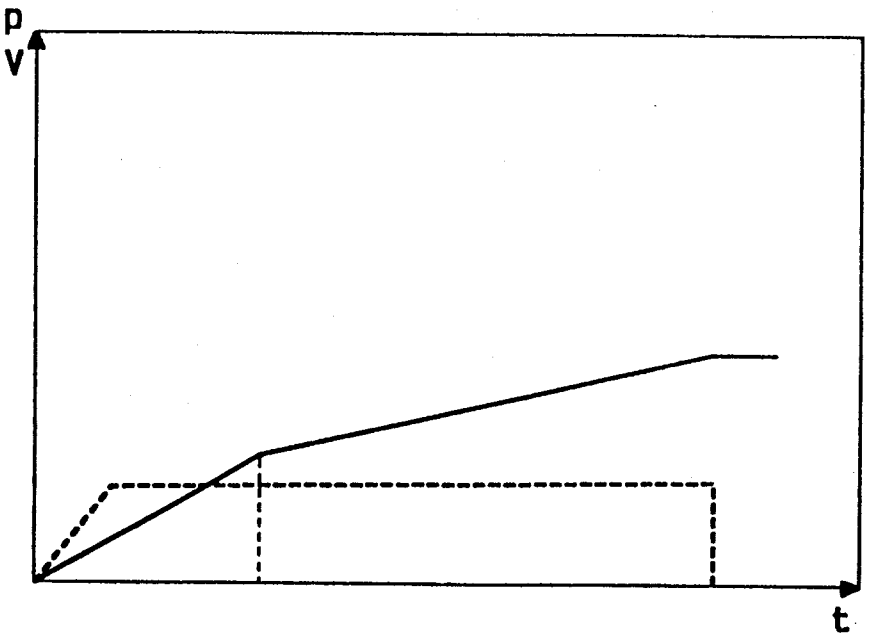
FIG. 2 is a diagram of variation in the pressure of the forced-back molten metal noted during initial moulding, the piston of the positive displacement pump being driven at a constant speed of displacement.

On the basis of the indications thus noted, it is consequently possible to draw up a diagram of the variations in speed V of displacement of the piston 4 and in pressure P of the forced-back molten metal as a function of time T which, in the case of the production of a core corresponding to the cavity of the mould 1 shown in FIG. 1, is illustrated in FIG. 2.

In this diagram, it may be observed, on the one hand, that the speed V of displacement of the piston (shown in broken lines) is constant and, on the other hand, that the pressure P of the forced-back molten metal (shown in solid line) exhibits a sudden variation. This sudden variation in pressure corresponds, in fact, to the passage of the front of molten metal forced back into a cross-section of the cavity of the mould having an increased variation in cross-section, as shown in FIG. 1.

On the basis of the diagram in FIG. 2, it thus becomes possible to determine the position of the piston corresponding to a sudden variation in pressure and to calculate the progressive increase in speed to be imposed on the displacement of the piston at this location, in order to prevent this variation in pressure.

Figure 3:
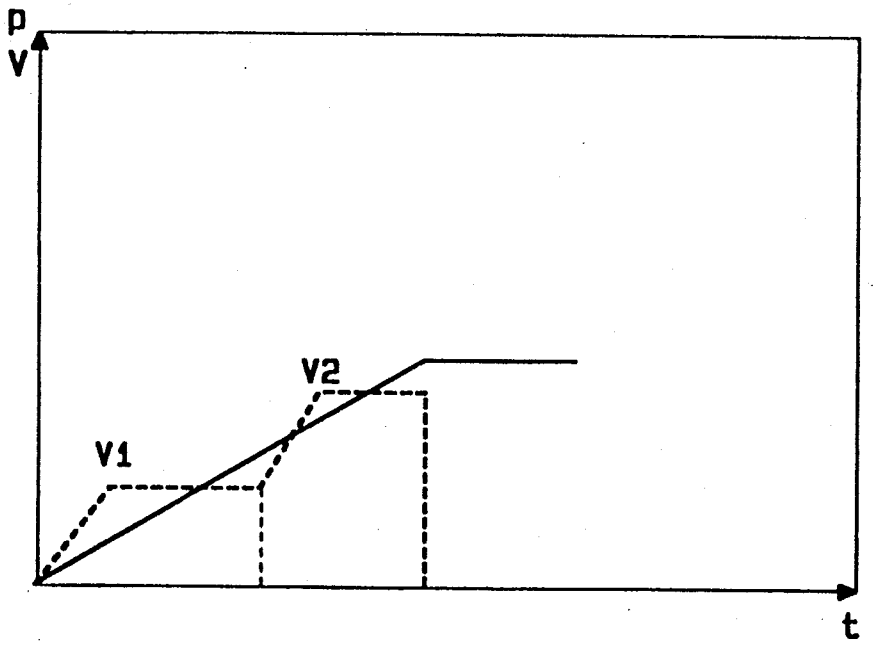
FIG. 3 is a diagram of variation in the pressure of the forced-back molten metal and of the speed of displacement of the piston imposed in the method according to the invention.

When this correction is imposed by the regulator 12, it is possible to start a continuous manufacturing cycle. The diagram of the pressures of the forced-back molten metal and of the speeds of displacement of the piston noted during these cycles is given in FIG. 3.

In this diagram, it may be observed that the rise in pressure P, illustrated in solid lines, is maintained constant, without a sudden variation, by a modification of the speed V of displacement of the piston, illustrated in broken lines, during filling of the mould (passage from a speed V1 to a higher speed V2 at the moment when the front of the metal forced back into the mould reaches an increased cross-section).

What is claimed is:

1. A method for molding a fusible core from a molten metal, comprising:

a. filling a mold by forcing back molten metal under pressure into the mold by means of a positive displacement pump equipped with a pressure regulator and having an output rate, total filling of the mold corresponding to a manometric height;

b. measuring the pressure of the forced-back metal;

c. adapting the output rate of the positive displacement pump so that the growing pressure imposed on the forced-back molten metal does not undergo any sudden variation during filling of the mold; and d. limiting the pressure exerted on the molten metal to a maximum pressure value which is slightly higher than the manometric height.

2. The method according to claim 1, wherein the positive displacement pump is a piston pump which is comprised of a piston having a displacement speed, which is controlled by a rapid regulation loop, and which is commanded by a hydraulic distributor; and wherein adapting the output rate of the positive displacement pump is accomplished by controlling the displacement speed of the piston so as to prevent any sudden variation in the pressure exerted on the molten metal forced-back into the mold during filling thereof.

3. The method according to claim 1, wherein filling of the mold is accomplished according to a growing pressure profile for the molten metal forced-back into the mold which is predetermined; wherein the pressure of the molten metal forced-back during manufacture is continuously measured; and wherein the output rate of the positive displacement pump is continuously regulated on the basis of the continuously measured pressure so as to comply with the predetermined growing pressure profile.

* * * * *